US005579670A

United States Patent [19]

McCormick

[11] Patent Number: 5,579,670

[45] Date of Patent: Dec. 3, 1996

[54] METHOD AND SYSTEM FOR MAKING QUILTING PIECES

[76] Inventor: Carolyn D. McCormick, 507 Staudaher, Bozeman, Mont. 59715

[21] Appl. No.: 307,172

[22] Filed: Sep. 16, 1994

[51] Int. Cl.[6] ..... A41H 3/00

[52] U.S. Cl. ..... 83/56; 33/562

[58] Field of Search ..... 83/745, 565, 56; 33/18.1, 27.12, 42, 485, 489, 562, 566; 30/315, 164.95

[56] References Cited

U.S. PATENT DOCUMENTS

| | | | |
|---|---|---|---|
| 32,571 | 6/1861 | Lane | 33/492 |
| 1,257,683 | 2/1918 | Defenbaugh | 33/42 |
| 2,215,499 | 9/1940 | Glick | 33/11 |
| 2,233,481 | 3/1941 | Kuehl | 33/107 |
| 2,450,769 | 10/1948 | Rothblum | 33/42 |
| 2,522,908 | 9/1950 | Szabo | 33/489 |
| 3,352,466 | 11/1967 | McAllister | 223/38 |
| 3,380,164 | 4/1968 | Norbedo | 33/42 |
| 4,301,594 | 11/1981 | Okada | 30/164.9 |
| 4,930,382 | 6/1990 | Collins | 33/562 |
| 4,945,642 | 8/1990 | Saulietis | 33/562 |
| 5,365,822 | 11/1994 | Stapleton et al. | 83/745 |

*Primary Examiner*—Rinaldi I. Rada
*Assistant Examiner*—Elizabeth Stanley
*Attorney, Agent, or Firm*—Richard C. Conover

[57] ABSTRACT

An improved system and method for cutting a quilting piece from fabric, which quilting piece has a constant width sewing expanse around the exposed area of the quilting piece for sewing quilting pieces together. The system includes a template conforming to the shape of the exposed area of the quilting piece and a cutter guide having a rail positioned along one edge of the cutter guide. The width of the rail is selected to correspond to the desired sewing expanse. The template is first positioned on the fabric to be cut and a cutter guide is positioned on top of the template with the inner guide edge of the rail positioned in abutting relation with an edge of the template. The fabric is then cut with a cutter along an outside cutting edge of the rail of the cutter guide.

1 Claim, 1 Drawing Sheet

METHOD AND SYSTEM FOR MAKING QUILTING PIECES

BACKGROUND OF THE INVENTION

This invention relates to an improved method and apparatus for making quilting pieces having a sewing expanse of constant width on each edge of the quilting piece.

Quilting requires precision sewing to fit all the various pieces of a pattern together. Each quilting piece must be provided with a sewing expanse on each edge of the quilting piece to allow for sewing the quilting pieces together to form a quilt. Conventionally, seamstresses mark on the fabric a cutting line which is separated from the sewing line of the quilting piece by about ¼ inch. The fabric is then cut along the cutting line and the cut out piece now has the quilting piece surrounded by a sewing expanse to allow for sewing the quilting pieces together.

Mechanical means for marking a line spaced apart a fixed distance from a master pattern is known. See for example, U.S. Pat. No. 2,215,499 to Glick. A device for sewing a hem on a window shade a fixed distance from an edge is shown in U.S. Pat. No. 3,352,466 to McAllister. Neither of these devices, however, could be used to cut a quilting piece so that the quilting piece has a sewing expanse for sewing the quilt pieces together.

A need exists for a system to cut quilt pieces from fabric which automatically allows for a sewing expanse.

SUMMARY OF INVENTION

The present invention relates to an improved quilting piece cutting system and method for cutting a quilting piece from fabric which quilting piece has a constant width sewing expanse around the exposed area of the quilting piece for sewing the quilting pieces together. The exposed area of the quilting piece being the area of the quilting piece exposed when the quilt is constructed.

The system includes a template conforming to the shape of the exposed area of the quilting piece and a cutter guide having a rail positioned along one edge of the cutter guide. The width of the rail is selected to correspond to the desired sewing expanse. The template is first positioned on the fabric to be cut and the cutter guide is positioned on top of the template with the inner guide edge of the rail positioned in abutting relation with an edge of the template. The fabric is then cut with a cutter along an outer cutting edge of the rail of the cutter guide.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
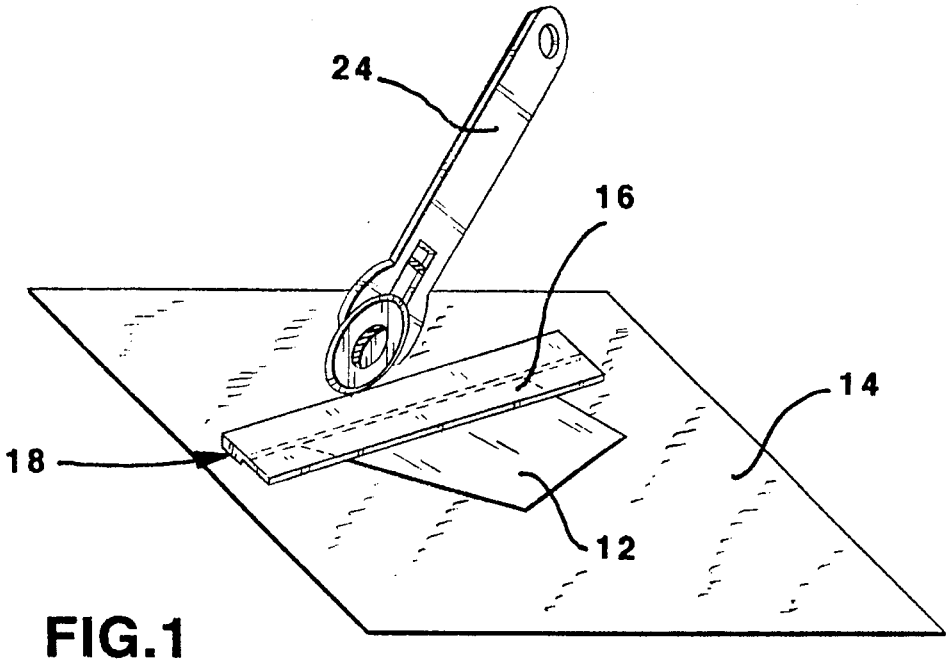
FIG. 1 is a perspective view of an improved system for making quilting pieces according to the present invention.

A preferred embodiment of an improved system for making quilting pieces is shown in FIG. 1. A template 12 is cut out of a material such as plastic and is cut to have a shape conforming to the exposed area of a quilting piece to be used in making a quilt. The template 12 is placed on top of the quilting fabric 14 in the position where the quilting piece is to be cut from the fabric.

Figure 2:
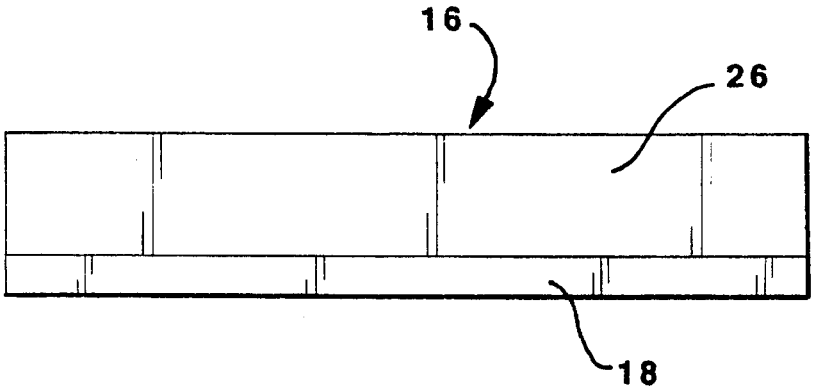
FIG. 2 is a bottom plan view of a cutter guide shown in FIG. 1.
Figure 3:
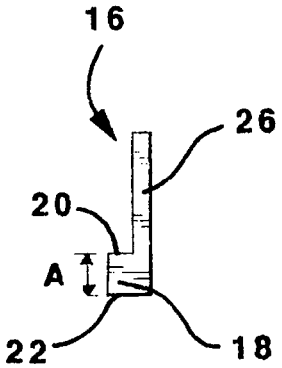
FIG. 3 is a right side view of the cutter guide shown in FIG. 2.

A cutter guide 16 is shown in FIGS. 1, 2 and 3. As shown, this cutter guide 16 is a straight edge. However, other shapes of cutter guides could be used just as effectively. Cutter guide 16 has a depending rail 18 as shown in FIGS. 2 and 3. The width A of the rail 18 is selected to correspond to the desired sewing expanse. This rail provides an inner guide edge 20 and an outer cutting edge 22. As shown in FIG. 1, the cutter guide 16 is placed over the template with the inner guide edge 20 abutting an edge of the template 12. The portion 26 of cutter guide 16 which extends from the rail 18 acts as a retaining plate so that when a user presses down on a cutter guide 16 positioned with portion 26 over template 12, this pressure holds the template 12 in place against the underlying fabric 14.

Figure 4:
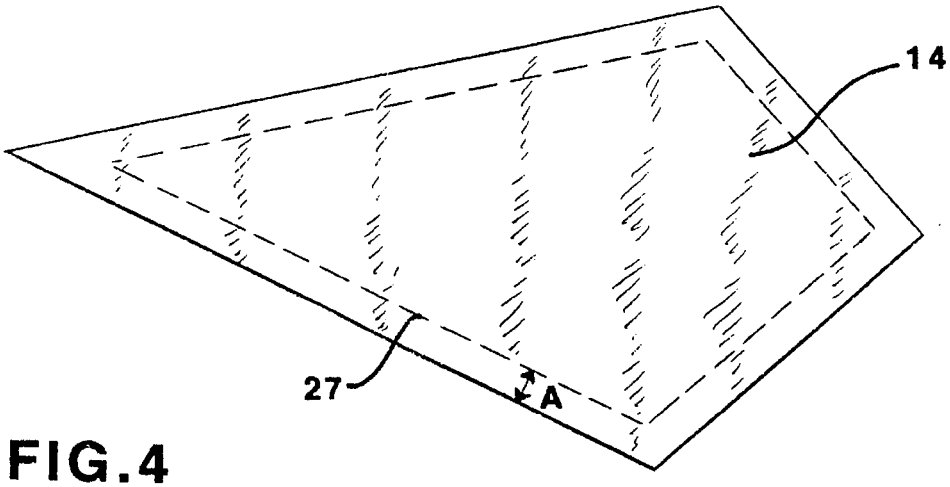
FIG. 4 is a representative quilting piece made with the present invention.

A cutting device 24, which in a preferred embodiment is a rotary cutter, is pushed or drawn along cutting edge 22 of cutter guide 16 to cut the fabric 14. The cut out portion of fabric 14 then corresponds to the pattern of template 12 with a sewing expanse corresponding to the width A of rail 18 as shown in FIG. 4. Once the fabric 14 is cut out, the cutter guide 16 can be removed. If a seamstress desires, the template may be kept in position on the now cut out piece and a pencil or pen can then be used to mark around the template 12 to mark the sewing line 27 of the quilt piece.

Since quilting is a repetitive process with a small number of patterns used repeatedly, a single template will be reused many times.

With this system, a new quilt can easily be designed using templates that match only the exposed fabric pattern in the new quilt design. The cutter guide provides a way of cutting the fabric to make a quilting piece having a sewing expanse which is used for sewing the quilting pieces together. With this invention a seamstress can design the quilt using the exposed portion of the quilting pieces to form the template and does not have to make a pattern which has the sewing expanse added on to the original exposed area of the quilting piece. The present invention eliminates many of the steps the conventional seamstress must go through in preparing quilting pieces for sewing together to make a quilt.

While the fundamental novel features of the invention have been shown and described, it should be understood that various substitutions, modifications, and variations may be made by those skilled in the art without departing from the spirit or scope of the invention. Accordingly, all such modifications or variations are included in the scope of the invention as defined by the following claims.

I claim:

1. A method for cutting out quilting pieces, having an exposed area, from fabric comprising:

preparing a template conforming to the shape of the exposed area of the quilting piece;

providing a cutter guide having a rail positioned along one edge of the cutter guide, the width of the rail corresponding to a desired sewing expanse;

placing the cutter guide on the template with an inner guide edge of the rail in abutting relation with an edge of the template;

placing the template and cutter guide over the exposed area of the fabric to be cut;

cutting the fabric along an outer cutting edge of the rail of the cutter guide while maintaining the cutter guide in stationary relation with the template; and whereby a cut out quilting piece has the exposed area of the quilting piece expanded in size by the desired sewing expanse.

* * * * *